US010580392B2

(12) United States Patent
Drake et al.

(10) Patent No.: US 10,580,392 B2
(45) Date of Patent: Mar. 3, 2020

(54) DEVICE TO PROTECT AN EDGE OF AN OBJECT

(71) Applicants: William-Henry Chase Drake, Round Rock, TX (US); Rochelle Marie Drake, Round Rock, TX (US); William Lee Drake, Round Rock, TX (US)

(72) Inventors: William-Henry Chase Drake, Round Rock, TX (US); Rochelle Marie Drake, Round Rock, TX (US); William Lee Drake, Round Rock, TX (US)

(73) Assignees: William Lee Drake, Round Rock, TX (US); Rochelle Marie Drake, Round Rock, TX (US); William Henry Chase Drake, Round Rock, TX (US)

( * ) Notice: Subject to any disclaimer, the term of this patent is extended or adjusted under 35 U.S.C. 154(b) by 9 days.

(21) Appl. No.: 15/946,272

(22) Filed: Apr. 5, 2018

(65) Prior Publication Data

US 2019/0122645 A1 Apr. 25, 2019

Related U.S. Application Data

(60) Provisional application No. 62/575,256, filed on Oct. 20, 2017.

(51) Int. Cl.
*G10G 7/00* (2006.01)
*G10D 7/10* (2006.01)

(52) U.S. Cl.
CPC ..... *G10G 7/00* (2013.01); *G10D 7/10* (2013.01)

(58) Field of Classification Search
CPC ..... G10G 7/00; G10D 7/10
See application file for complete search history.

(56) References Cited

U.S. PATENT DOCUMENTS

| | | | | |
|---|---|---|---|---|
| 4,779,465 | A | 10/1988 | Stearns et al. | |
| D308,217 | S | 5/1990 | Cohen | |
| 6,177,622 | B1 | 1/2001 | Green | |
| 6,239,338 | B1 | 5/2001 | Robinson | |
| 6,464,074 | B1 | 10/2002 | Dimbath | |
| 6,945,396 | B2 | 9/2005 | Dimbath | |
| 7,227,070 | B2 | 6/2007 | Biba | |
| 7,971,712 | B2 | 7/2011 | Talwar et al. | |
| 8,304,640 | B1 * | 11/2012 | Barnfield | G10D 9/00 84/453 |
| 9,653,051 | B2 | 5/2017 | Adachi | |
| 2004/0118717 | A1 | 6/2004 | Dimbath | |

(Continued)

OTHER PUBLICATIONS

Band Shieldz Trumpet Protection Kit, http://www.wwbw.com/Band-Shieldz-Trumpet-Protection-Kit-J14205.wwbw, printed Apr. 17, 2018, 2 pages.

(Continued)

*Primary Examiner* — Kimberly R Lockett
(74) *Attorney, Agent, or Firm* — Schwegman Lundberg & Woessner, P.A.

(57) ABSTRACT

Embodiments of devices to protect edges of objects are described. The objects can include musical instruments and the devices can be coupled to an edge of the musical instruments. One or more of the devices can be disposed around one or more portions of an edge of a musical instrument to minimize or prevent contact between the edge of the musical instrument and surfaces or other objects that may contact the musical instrument.

20 Claims, 10 Drawing Sheets

(56) References Cited

U.S. PATENT DOCUMENTS

| | | | | |
|---|---|---|---|---|
| 2006/0060060 | A1 | 3/2006 | Breske et al. | |
| 2007/0095194 | A1 | 5/2007 | Moerth | |
| 2009/0302081 | A1 | 12/2009 | Kriesel | |
| 2011/0241411 | A1* | 10/2011 | Fynn | B60B 7/01 301/37.24 |
| 2011/0253568 | A1 | 10/2011 | Wright | |
| 2012/0104215 | A1* | 5/2012 | Benach | G10D 13/00 248/346.5 |
| 2012/0266735 | A1 | 10/2012 | Dunlop | |
| 2016/0063972 | A1 | 3/2016 | Finkle | |
| 2016/0335993 | A1 | 11/2016 | Keller | |

OTHER PUBLICATIONS

Edgee Bell Edge Protectors—Band Footwear, Marching Band Accessories, http://www.ecbensonassociates.com/-edgee-bell-edge-protectors/, printed Apr. 17, 2018, 1 page.

Hercules Stands—Winds and Percussion, Low Brass, http://herculesstands.com/international/products/winds-and-percussion/low-brass/, printed Apr. 17, 2018, 4 pages.

"Placing a Horn on its Bell," dwerden.com, Forum 18971, http://www.dwerden.com/forum/showthread.php/18971-Placing-a-horn-on-it-s-bell/page2#.WVargYTyuM8, printed Apr. 17, 2018, 7 pages.

Thomann Bell Ring 0 30 cm, bell ring for tuba, tenor horn, baritone, euphonium. https://www.thomann.de/gb/thomann_schallstueckring30cm.htm, printed Apr. 17, 2018, 1 page.

"Bell Protection Idea," TubeNet, Topic 56807, http://forums.chisham.com/viewtopic.php?f=2&t=56807, printed Apr. 17, 2018, 14 pages.

"Vinyl Bands that Clip on to Tuba Bell Rims," TubeNet, Topic 58071, http://forums.chisham.com/viewtopic.php?f=2&t=58071, printed Apr. 17, 2018, 12 pages.

Warmahorn—Euphonium/French Horn Rim Gard 11, https://www.amazon.co.uk/Warmahorn-Euphonium-French-Guard-Neoprene/dp/B00D43I9PS, printed Apr. 17, 2018, 1 page.

"Care and Maintenance of a Horn: How to take care of a horn-Musical Instrument Guide," Yamaha.com, https://www.yamaha.com/en/musical_instrument_guide/horn/maintenance/maintenance004.html, printed Apr. 17, 2018, 5 pages.

* cited by examiner

DEVICE TO PROTECT AN EDGE OF AN OBJECT

PRIORITY CLAIM AND CROSS-REFERENCE TO RELATED APPLICATION

This application claims the benefit of and priority to U.S. patent application Ser. No. 62/575,256, filed on Oct. 20, 2017, and entitled "Method and Device to Safeguard the Rim of a Musical Instrument," the entire disclosure of which is incorporated by reference in its entirety herein.

BACKGROUND

Edges of objects can be easily damaged. For example, when objects contact each other, the contact typically takes place between one or more edges of the particular objects. In certain situations, an edge of an object can be damaged when the object is placed onto a surface. As an edge of an object contacts a portion of another object, the edge can be damaged based on the hardness of the materials that comprise the objects that are being contacted. Damage to an edge of an object can affect the appearance, value, and/or performance of the object. In a particular example, a rim of a musical instrument can be damaged when contacted by another object. To illustrate, setting a rim of an instrument, such as a tuba, euphonium, baritone, mellophone, horn, drum, or trumpet onto a hard surface can damage the rim of the musical instrument.

DETAILED DESCRIPTION

Figure 1:
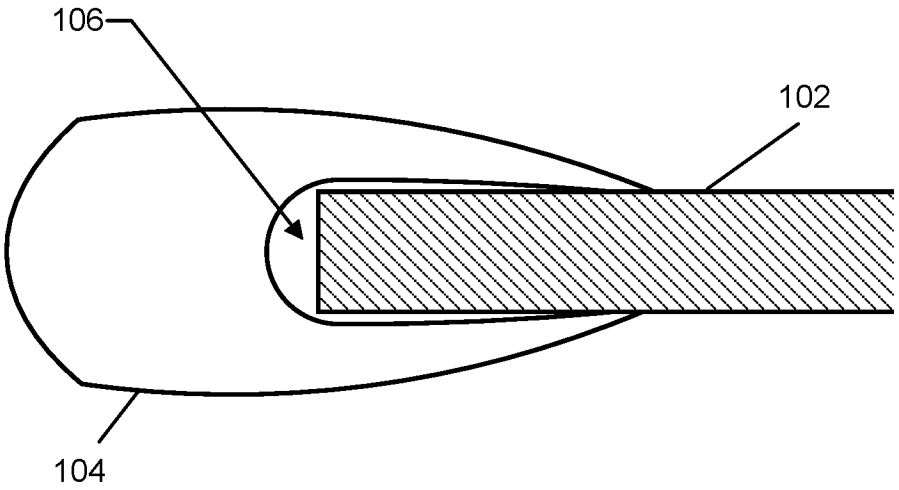
FIG. 1 is a side view of an edge of an object and an edge protection device coupled to an edge of the object according to some embodiments.

The concepts described herein are directed to protecting edges of objects from being damaged. In particular, the embodiments described in this patent application are directed to edge protection devices that can be attached to one or more locations on an edge of an object and protect the edge of the object from contacting other objects. In various implementations, the edge protection devices can be coupled to an edge of a musical instrument, such as a tuba, euphonium, baritone, mellophone, trumpet, horn, or drum.

During rehearsals, practices, and performances, musicians can set their instruments down when the instruments are not in use. In certain situations, the instruments can be set onto surfaces that are hard, rough, and/or abrasive. For example, bandshells can have concrete floors and marching bands can perform on hard surfaces, such as asphalt or concrete. When instruments that are not in use are placed onto these hard surfaces, the edges of the instruments can contact the hard surfaces, which can result in scratches, abrasions, dents, and other forms of damage to the instruments. To illustrate, the rim of a tuba, euphonium, baritone, mellophone, trumpet, horn, or drum can be damaged when placed onto a surface without any device to protect the rim. Setting instruments onto surfaces can also produce unwanted noise, such as during a performance.

Conventional devices for protecting the edge of a musical instrument typically include a ring of cushioning material or tubing that encircles the rim of the instrument. Since these conventional protection devices encircle most, if not all, of the rim of the musical instrument, these conventional protection devices can create a distracting or unappealing appearance to the instrument. Also, the presence of the conventional protection device on the instrument can affect the quality of the sound produced by the instrument. Additionally, in some cases, these conventional protection devices cover at least a portion of the opening of the bell of the instrument or cover the playing surface of a drum, which also affects the appearance and sound quality of the instrument when these conventional protection devices are attached to the instrument.

Furthermore, conventional protection devices can cause an instrument to become unstable when the instrument is placed onto a surface. For example, a tuba, euphonium, baritone, mellophone, trumpet, or horn with a conventional protection device attached to its bell can fall over when the bell is placed onto the ground. To illustrate, certain conventional protection devices can be formed from a material that is soft and overly flexible and when an instrument that includes the conventional protection device is placed onto a surface, the surface of the conventional protection device may not be distributed evenly around the rim of the instrument, thus causing the instrument to fall over. Also, due to the size of conventional protection devices, these devices may not be conveniently removed and/or stored during a performance. Instrument stands can be utilized to hold instruments when not in use during a performance, however, instrument stands are not feasible to utilize with respect to larger instruments during performances or in situations where the musicians are often in motion during performances, such as during a performance of a marching band, because of the size, shape, and/or weight of the instrument stands.

The embodiments of the edge protection devices described herein can be placed securely on the edge of an object to prevent the object from contacting a surface or another object. For example, an edge protection device can be placed at multiple locations along the edge of an object and provide a buffer between the edge of the object and other objects or surfaces. In illustrative examples, the edge protection device can be located on a rim of a musical instrument. In particular, the embodiments of the edge protection devices described herein can be clipped to the rim of a musical instrument and stay securely in place when attached to the rim. The edge protection device can be formed from a material that enables an instrument including one or more of the edge protection devices to be placed onto a surface without producing very much, if any, noise.

Additionally, the embodiments of the edge protection devices can remain on the instrument while the instrument is being played with minimal, if any, effect on the sound quality of the instrument. That is, the sound produced by the musical instrument when the edge protection device is attached to the rim of the musical instrument is the same or approximately the same as the sound produced by the musical instrument when the edge protection device is removed from the rim of the musical instrument. The edge protection devices can also provide a stable footprint for an object to which the edge protection devices are attached. For example, musical instruments can stand up on their bells without falling over when the edge protection devices described herein are attached to the rims of the bells.

Certain embodiments of the edge protection devices described herein are also small enough to conveniently store inside a pocket or instrument case and can be quickly placed onto or removed from the edge of an object. The placement of the edge protection device onto a surface of an object or the removal of the edge protection device does not damage the object and the object is not modified in order to place the edge protection device onto the object. The edge protection devices described herein can be customized and personalized in addition to being utilized on objects having a variety of shapes and sizes.

FIG. 1 is a side view of an edge 102 of an object and an edge protection device 104 coupled to the edge 102 of the object according to some embodiments. The edge protection device 104 can include a cavity 106 that encases the edge 102 of the object. In certain implementations, the cavity 106 can include a terminal region of the edge protection device 104 that may be open on more than one side. The edge protection device 104 can be formed from a material that is flexible and enables the edge protection device 104 to conform to at least a portion of the edge 102. Additionally, in various embodiments, the cavity 106 can have a shape that corresponds to a shape of the edge 102. Further, dimensions of the edge protection device 104 and dimensions of the cavity 106 can correspond to dimensions of the edge 102. In particular implementations, the edge 102 can be associated with various types of objects, such as musical instruments, furniture, household items, tools, electronic devices, and the like.

Figure 2:
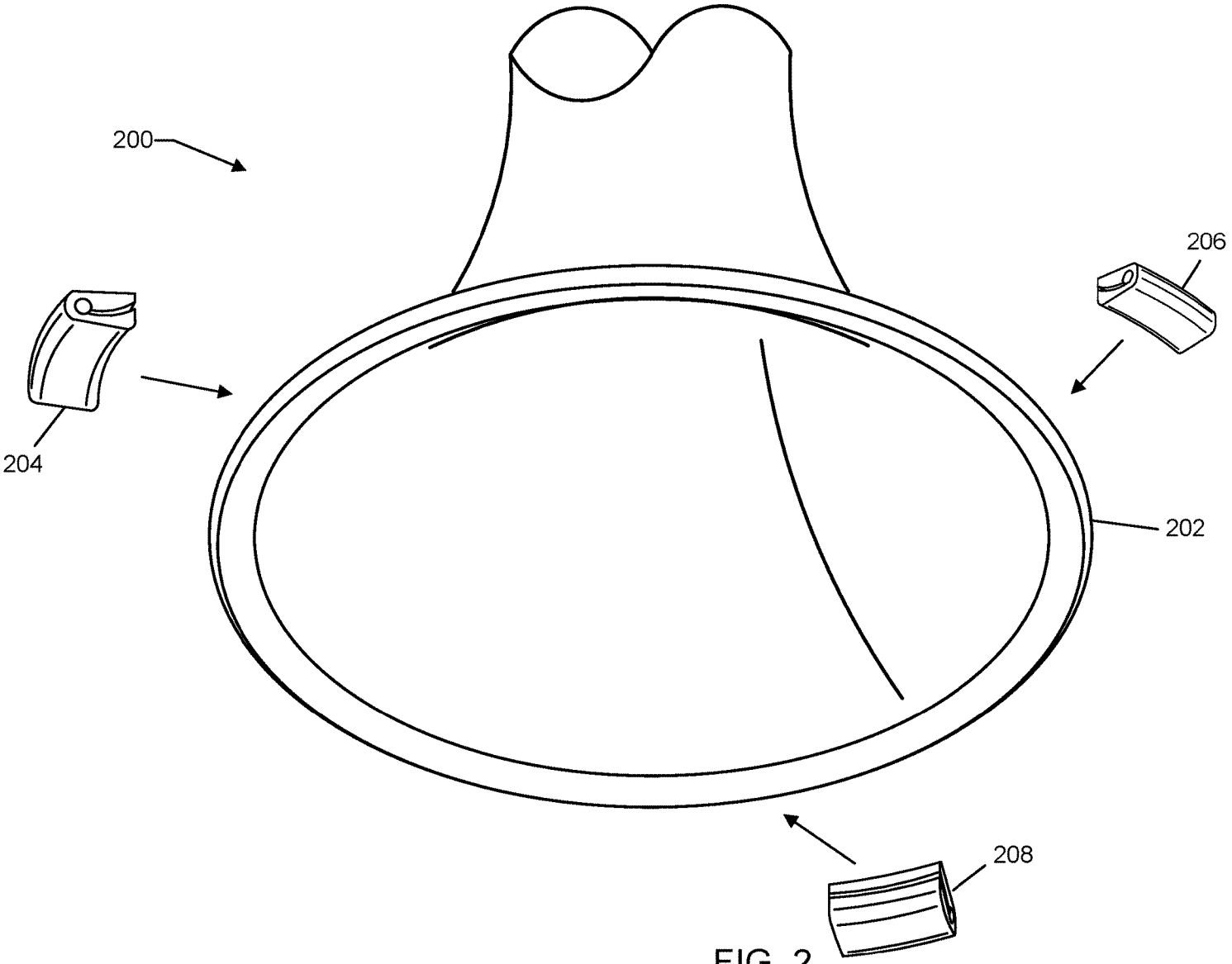
FIG. 2 is a perspective, sectional view of a musical instrument showing locations to place multiple edge protection devices onto an edge of an object according to some embodiments.

FIG. 2 is a perspective, sectional view of a musical instrument 200 showing locations to place multiple edge protection devices onto an edge 202 of the musical instrument 200 according to some embodiments. A first edge protection device 204 can be placed at a first location of the edge 202, a second edge protection device 206 can be placed at a second location of the edge 202, and a third edge protection device 208 can be placed at a third location of the edge 202. The edge protection devices 204, 206, 208 can work together to prevent the edge 202 of the object 200 from contacting a surface. For example, in situations where the musical instrument 200 is to be placed on a surface, the edge protection devices 204, 206, 208 contact the surface and the musical instrument 200 does not contact the surface. In an illustrative example, the edge 202 can be a rim of the bell of the musical instrument. The musical instrument 200 can include a tuba, a euphonium, a baritone, a mellophone, a trumpet, a horn, or a drum.

As shown in the illustrative example of FIG. 2, the edge protection devices 204, 206, 208 are located on a portion of the circumference of the edge 202. Although the illustrative example of FIG. 2 shows three edge protection devices coupled to the edge 202, other embodiments can include fewer edge protection devices, such as 1 or 2, coupled to the rim of an object or more edge protection devices, such as 4, 5, 6, 7, 8, or more, coupled to the rim of an object. Additionally, although the edge protection devices 204, 206, 208 are substantially a same size in the illustrative example of FIG. 2, the edge protection devices 204, 206, 208 can have different sizes. To illustrate, the edge protection devices 204, 206 can have a similar size, while the edge protection device 208 can be larger than the edge protection devices 204, 206. In other embodiments, the edge protection devices 204, 206 can be larger than the edge protection device 208.

In some examples, multiple edge protection devices together can cover a portion of the circumference of the edge 202. For example, multiple edge protection devices can cover no greater than about 90% of the circumference of the edge 202, no greater than about 80% of the circumference of the edge 202, no greater than about 70% of the circumference of the edge 202, no greater than about 60% of the circumference of the edge 202, or no greater than about 50% of the circumference of the edge 202. Additionally, multiple edge protection devices together can cover at least about 2% of the circumference of the edge 202, at least about 5% of the circumference of the edge 202, at least about 10% of the circumference of the edge 202, at least about 20% of the circumference of the edge 202, at least about 30% of the circumference of the edge 202, or at least about 40% of the circumference of the edge 202. Furthermore, the portion of the circumference of the edge 202 covered by multiple edge protection devices can lie within a range that includes various combinations of the amounts listed in this paragraph.

In some examples, a size of the edge protection devices and a number of the edge protection devices used to protect a musical instrument can be based on the size of the bell of the musical instrument. For example, smaller edge protection devices and/or fewer edge protection devices can be utilized to protect a bell of a trumpet in relation to the size and/or number of edge protection devices utilized to protect a bell of a euphonium. Additionally, an amount of the circumference covered by the edge protection devices can be based on the size of the edge protection devices and a size of the bell of the musical instrument.

In various examples, multiple edge protection devices can cover from about 5% to about 35% of the circumference of the edge 202. In other examples, multiple edge protection devices can cover from about 10% to about 25% of the circumference of the edge 202. In additional example, multiple edge protection devices can cover from about 30% to about 50% of the circumference of the edge 202. In illustrative examples, three edge protection devices together can cover from about 2% to about 30% of the circumference of the edge 202. In another illustrative example, three edge protection devices together can cover from about 5% to about 25% of the circumference of the edge 202. In an additional illustrative example, three edge protection devices together can cover from about 10% to about 20% of the circumference of the edge 202. In further illustrative examples, two edge protection devices together can cover from about 2% to about 25% of the circumference of the edge 202. In still other illustrative examples, two edge protection devices together can cover from about 5% to about 20% of the circumference of the edge 202. In certain illustrative examples, two edge protection devices together can cover from about 8% to about 15% of the circumference of the edge 202. In various illustrative examples, four edge protection devices together can cover from about 5% to about 40% of the circumference of the edge 202. In particular illustrative examples, four edge protection devices together can cover from about 10% to about 30% of the circumference of the edge 202. In still additional illustrative examples, four edge protection devices together can cover from about 15% to about 25% of the circumference of the edge 202.

The edge protection devices 204, 206, 208 can be formed from various materials and using a variety of manufacturing processes. In some illustrative embodiments, the edge protection devices 204, 206, 208 can be formed from a polymeric material. For example, the edge protection devices 204, 206, 208 can be formed from a thermoplastic material. In particular embodiments, the edge protection devices 204, 206, 208 can be formed from a polyurethane-containing material. In other embodiments, the edge protection devices 204, 206, 208 can be formed from a polyester material. For example, the edge protection devices 204, 206, 208 can be formed from a polylactic acid (PLA). In various embodiments, the edge protection devices 204, 206, 208 can be formed using an additive manufacturing process. In additional embodiments, the edge protection devices 204, 206, 208 can be formed using a molding process. To illustrate, the edge protection devices 204, 206, 208 can be formed from an injection molding process. In various implementations, the edge protection devices 204, 206, 208 can include a plurality of layers of a polymeric material with one layer of polymeric material formed on top of another layer where individual layers of the plurality of layers have a height from about 0.05 mm to about 0.5 mm.

In certain embodiments, the edge protection devices 204, 206, 208 can be formed from a material having an ultimate tensile strength from about 18 megapascals (Mpa) to about 35 Mpa and an elongation at break from about 500% to about 750%. The edge protection devices 204, 206, 208 can also be formed from a material having a Shore A hardness from about 75 to about 92 and a melting point from about 175° C. to about 250° C. In illustrative examples, the edge protection devices 204, 206, 208 can be formed from a material having an ultimate tensile strength from about 23 Mpa to about 29 Mpa, an elongation at break from about 640% to about 680%, a Shore A hardness from about 82 to 88, and a melting point from about 210° C. to about 220° C. In various embodiments, the ultimate tensile strength and elongation at break of the material used to form the edge protection devices 204, 206, 208 can be measured according to the American Society for Testing and Materials (ASTM) D638 protocol, the melting point can be determined using differential scanning calorimetry, and the Shore A hardness can be determined by the ASTM D2240 protocol.

Figure 3:
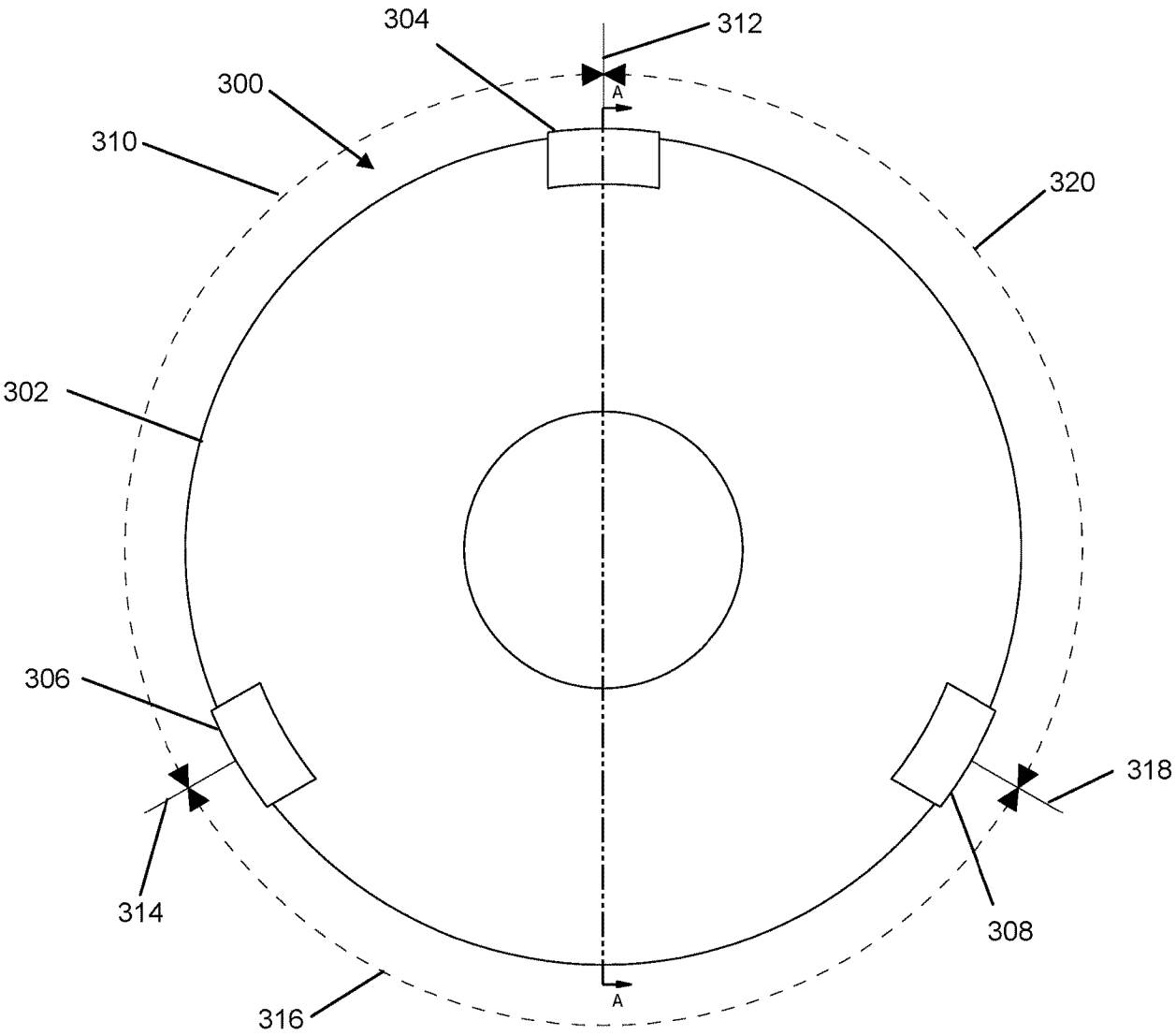
FIG. 3 is a view of the inside of a bell of a musical instrument along the conical axis of the bell and showing a first number of edge protection devices attached to the edge of the bell according to some embodiments.

FIG. 3 is a view of the inside of a bell 300 of a musical instrument along the conical axis of the bell 300 and showing a first number of edge protection devices attached to the edge of the bell 300 according to some embodiments. A line of symmetry of the bell 300 is shown by line A-A in FIG. 3. In the illustrative example of FIG. 3, the bell 300 includes an outer edge 302. The diameter of the bell 300 can be determined by measuring a distance between a first point on the edge to a second point on the edge directly across from the first point. The diameter of the bell 300 can depend on the type of musical instrument that includes the bell 300. For example, a trumpet can have a first set of diameters and a baritone horn can have a second set of diameters that is larger than the first set of diameters. Additionally, a euphonium can have a third set of diameters that is different from the first set of diameters and the second set of diameters, while a tuba can have a fourth set of diameters that is larger than the first, second, and third sets of diameters.

In some embodiments, a diameter of the bell 300 can be at least about 3 inches, at least about 5 inches, at least about 7 inches, at least about 10 inches, at least about 12 inches, at least about 15 inches, or at least about 18 inches. Additionally, a diameter of the bell 300 can be no greater than about 38 inches, no greater than about 35 inches, no greater than about 32 inches, no greater than about 30 inches, no greater than about 28 inches, no greater than about 25 inches, no greater than about 22 inches, or no greater than about 20 inches. In illustrative examples, a diameter of the bell 300 can be from about 3 inches to about 30 inches. In other illustrative examples, a diameter of the bell 300 can be from about 4 inches to about 10 inches. In additional illustrative examples, a diameter of the bell 300 can be from about 6 inches to about 15 inches. In further illustrative examples, a diameter of the bell 300 can be from about 10 inches to about 18 inches. In still other illustrative examples, a diameter of the bell 300 can be from about 15 inches to about 25 inches. In yet additional illustrative examples, a diameter of the bell 300 can be from about 18 inches to about 25 inches. In certain illustrative examples, a diameter of the bell 300 can be from about 20 inches to about 30 inches. In particular illustrative examples, a diameter of the bell 300 can be from about 25 inches to about 35 inches. In various illustrative examples, a diameter of the bell 300 can be from about 30 inches to about 40 inches. In addition, the diameter of the bell 300 can lie within a range that includes various combinations of the diameters listed in this paragraph.

Attached to the bell 300 in the illustrative example of FIG. 3 are a first edge protection device 304, a second edge protection device 306, and a third edge protection device 308. The first edge protection device 304 is separated from a second edge protection device 306 by a first distance 310. The first distance 310 can be measured from a center of the first edge protection device 304 indicated by reference identifier 312 and a center of the second edge protection device 306 indicated by reference identifier 314. Additionally, the second edge protection device 306 can be separated from the third edge protection device 308 by a second distance 316. The second distance 316 can be measured from the center 314 to a center of the third edge protection device 308 indicated by reference identifier 318. Further, the third edge protection device 308 can be separated from the first edge protection device 304 by a third distance 320. The third distance 320 can be measured from the center 318 to the center 312. For illustrative purposes, the first distance 310, the second distance 316, and the third distance 320 are shown as being beyond the circumference of the bell 300, but the distances 310, 316, 320 can be measured along the circumference of the bell 300.

In various embodiments, the first distance 310, the second distance 316, and the third distance 320 can have a value that is approximately a same value. For example, the first distance 310 can include about one-third of the circumference of the bell 300, the second distance 316 can include about one-third of the circumference of the bell 300, and the third distance 320 can include about one-third of the circumference of the bell 300. Thus, in certain embodiments, the edge protection devices 304, 306, 308 can be spaced substantially evenly around the circumference of the bell 300. In additional examples, one or more of the first distance 310, the second distance 316, and the third distance 320 can have different values. In some examples, the first distance 310, the second distance 316, and the third distance 320 can have a value from about 20% of the value of the circumference of the bell 300 to about 50% of the value of the circumference of the bell 300. In additional examples, the first distance 310, the second distance 316, and the third distance 320 can have a value from about 30% of the value of the circumference of the bell 300 to about 40% of the value of the circumference of the bell 300. In certain illustrative examples, the first distance 310 and the third distance 320 can have a value from about 20% of the value of the circumference of the bell 300 to about 30% of the value of the circumference of the bell 300 and the second distance 316 can have a value from about 40% of the value of the circumference of the bell 300 to about 60% of the value of the circumference of the bell 300.

In some embodiments, the distances 310, 316, 320 can individually be from about 1 inch to about 4 inches, from about 2 inches to about 6 inches, from about 3 inches to about 7 inches, from about 4 inches to about 8 inches, from about 5 inches to about 10 inches, from about 6 inches to about 12 inches, from about 7 inches to about 14 inches, from about 10 inches to about 18 inches, from about 15 inches to about 22 inches, from about 20 inches to about 28 inches, from about 25 inches to about 35 inches, from about 30 inches to about 40 inches, or from about 35 inches to about 45 inches. In various embodiments, the first distance 310 and the third distance 320 can be from about 1 inch to about 3 inches, from about 2 inches to about 4 inches, from about 3 inches to about 5 inches, from about 4 inches to about 6 inches, from about 5 inches to about 7 inches, from about 6 inches to about 8 inches, from about 8 inches to about 15 inches, from about 12 inches to about 18 inches, from about 15 inches to about 25 inches, from about 20 inches to about 30 inches, from about 25 inches to about 35 inches, from about 30 inches to about 40 inches, from about 40 inches to about 45 inches, while the second distance 316 can be from about 2 inches to about 5 inches, from about 3 inches to about 6 inches, from about 4 inches to about 7 inches, from about 5 inches to about 8 inches, from about 6 inches to about 9 inches, from about 7 inches to about 10 inches, from about 8 inches to about 11 inches, from about 9 inches to about 12 inches, from about 10 inches to about 15 inches, from about 12 inches to about 18 inches, from about 15 inches to about 25 inches, from about 20 inches to about 30 inches, from about 30 inches to about 35 inches.

Figure 4:
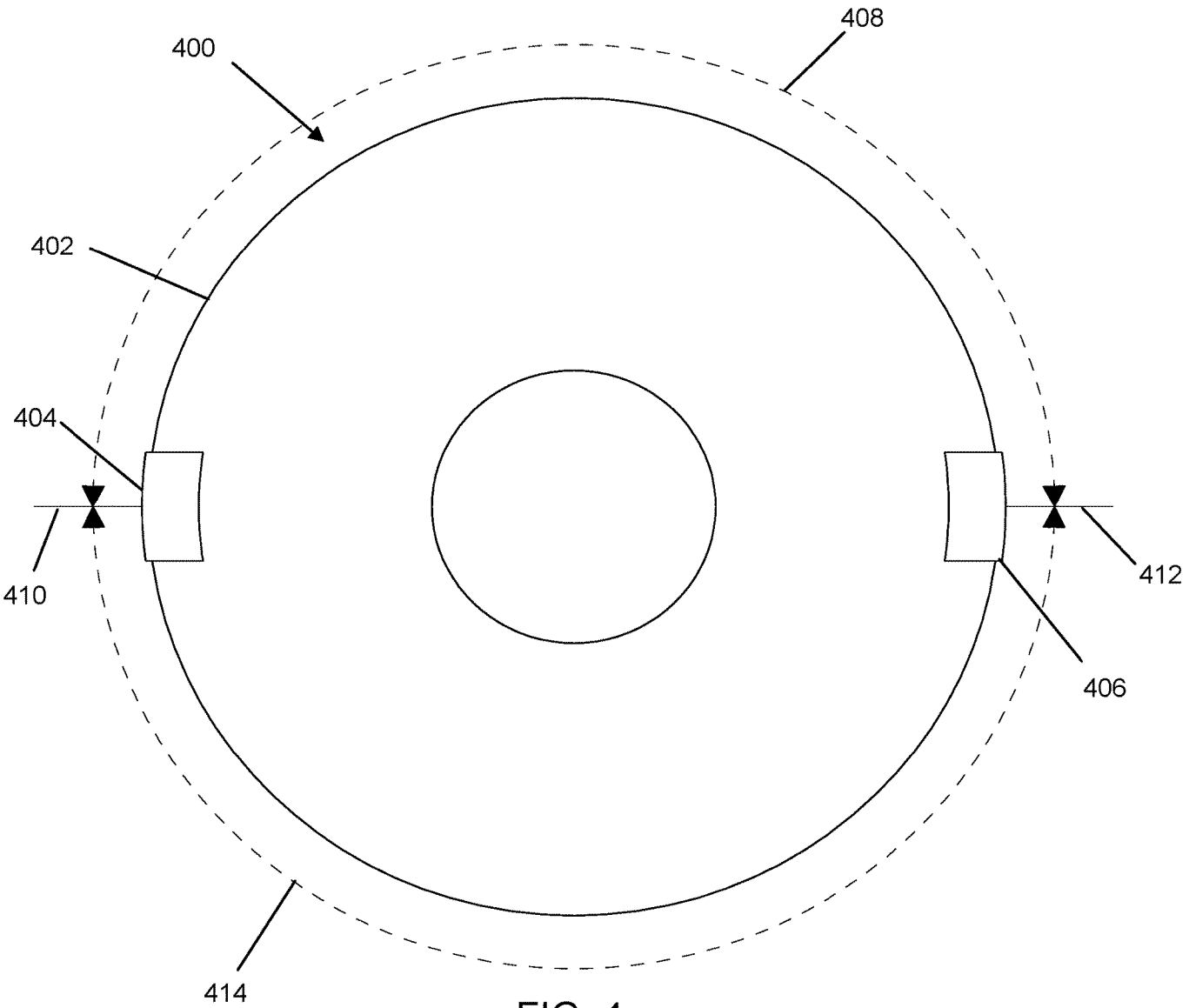
FIG. 4 is a view of the inside of the bell of a musical instrument along the conical axis of the bell and showing a second number of edge protection devices attached to the edge of the bell according to some embodiments.

FIG. 4 is a view of the inside of a bell 400 of a musical instrument along the conical axis of the bell 400 and showing a second number of edge protection devices attached to the edge of the bell 400 according to some embodiments. In the illustrative example of FIG. 4, the bell 400 includes an outer edge 402. The diameter of the bell 400 can be determined by measuring a distance between a first point on the edge to a second point on the edge directly across from the first point. The diameter of the bell 400 can depend on the type of musical instrument that includes the bell 400. For example, a trumpet can have a first set of diameters and a baritone horn can have a second set of diameters that is larger than the first set of diameters. Additionally, a euphonium can have a third set of diameters that is different from the first set of diameters and the second set of diameters, while a tuba can have a fourth set of diameters that is larger than the first, second, and third sets of diameters.

In some embodiments, a diameter of the bell 400 can be at least about 3 inches, at least about 5 inches, at least about 7 inches, at least about 10 inches, at least about 12 inches, at least about 15 inches, or at least about 18 inches. Additionally, a diameter of the bell 400 can be no greater than about 38 inches, no greater than about 35 inches, no greater than about 32 inches, no greater than about 30 inches, no greater than about 28 inches, no greater than about 25 inches, no greater than about 22 inches, or no greater than about 20 inches. In illustrative examples, a diameter of the bell 400 can be from about 3 inches to about 30 inches. In other illustrative examples, a diameter of the bell 400 can be from about 4 inches to about 10 inches. In additional illustrative examples, a diameter of the bell 400 can be from about 6 inches to about 15 inches. In further illustrative examples, a diameter of the bell 400 can be from about 10 inches to about 18 inches. In still other illustrative examples, a diameter of the bell 400 can be from about 15 inches to about 25 inches. In yet additional illustrative examples, a diameter of the bell 400 can be from about 18 inches to about 25 inches. In certain illustrative examples, a diameter of the bell 400 can be from about 20 inches to about 30 inches. In particular illustrative examples, a diameter of the bell 400 can be from about 25 inches to about 35 inches. In various illustrative examples, a diameter of the bell 400 can be from about 30 inches to about 40 inches. In addition, the diameter of the bell 400 can lie within a range that includes various combinations of the diameters listed in this paragraph.

Attached to the bell 400 in the illustrative example of FIG. 4 are a first edge protection device 404 and a second edge protection device 406. The first edge protection device 404 is separated from the second edge protection device 406 by a first distance 408. The first distance 408 can be measured from a center of the first edge protection device 404 indicated by reference identifier 410 and a center of the second edge protection device 406 indicated by reference identifier 412. Additionally, the first edge protection device 404 can be separated from the second edge protection device 406 by a second distance 414. The second distance 414 can be measured from the center 410 to the center 412. For illustrative purposes, the first distance 408 and the second distance 414 are shown as being beyond the circumference of the bell 400, but the distances 408, 414 can be measured along the circumference of the bell 400.

In various embodiments, the first distance 408 and the second distance 414 can have a value that is approximately a same value. For example, the first distance 408 can include about one-half of the circumference of the bell 400 and the second distance 414 can include about one-half of the circumference of the bell 400. Thus, in certain embodiments, the edge protection devices 404 and 406 can be spaced substantially evenly around the circumference of the bell 400. In additional examples, the first distance 408 and the second distance 414 can have different values. In some examples, the first distance 408 and the second distance 414 can have a value from about 40% of the value of the circumference of the bell 400 to about 60% of the value of the circumference of the bell 400.

In some embodiments, the distances 408 and 414 can be from about 1 inch to about 4 inches, from about 2 inches to about 6 inches, from about 3 inches to about 7 inches, from about 4 inches to about 8 inches, from about 5 inches to about 10 inches, from about 6 inches to about 12 inches, from about 7 inches to about 14 inches, from about 8 inches to about 16 inches, from about 9 inches to about 18 inches, from about 10 inches to about 20 inches, from about 15 inches to about 30 inches, from about 25 inches to about 35 inches, from about 30 inches to about 40 inches, from about 35 inches to about 45 inches, from about 40 inches to about 50 inches, from about 45 inches to about 55 inches, from about 50 inches to about 60 inches, or from about 55 inches to about 65 inches. In illustrative examples, the distances 408 and 414 can be from about 4 inches to about 65 inches or from about 10 inches to about 50 inches.

Figure 5:
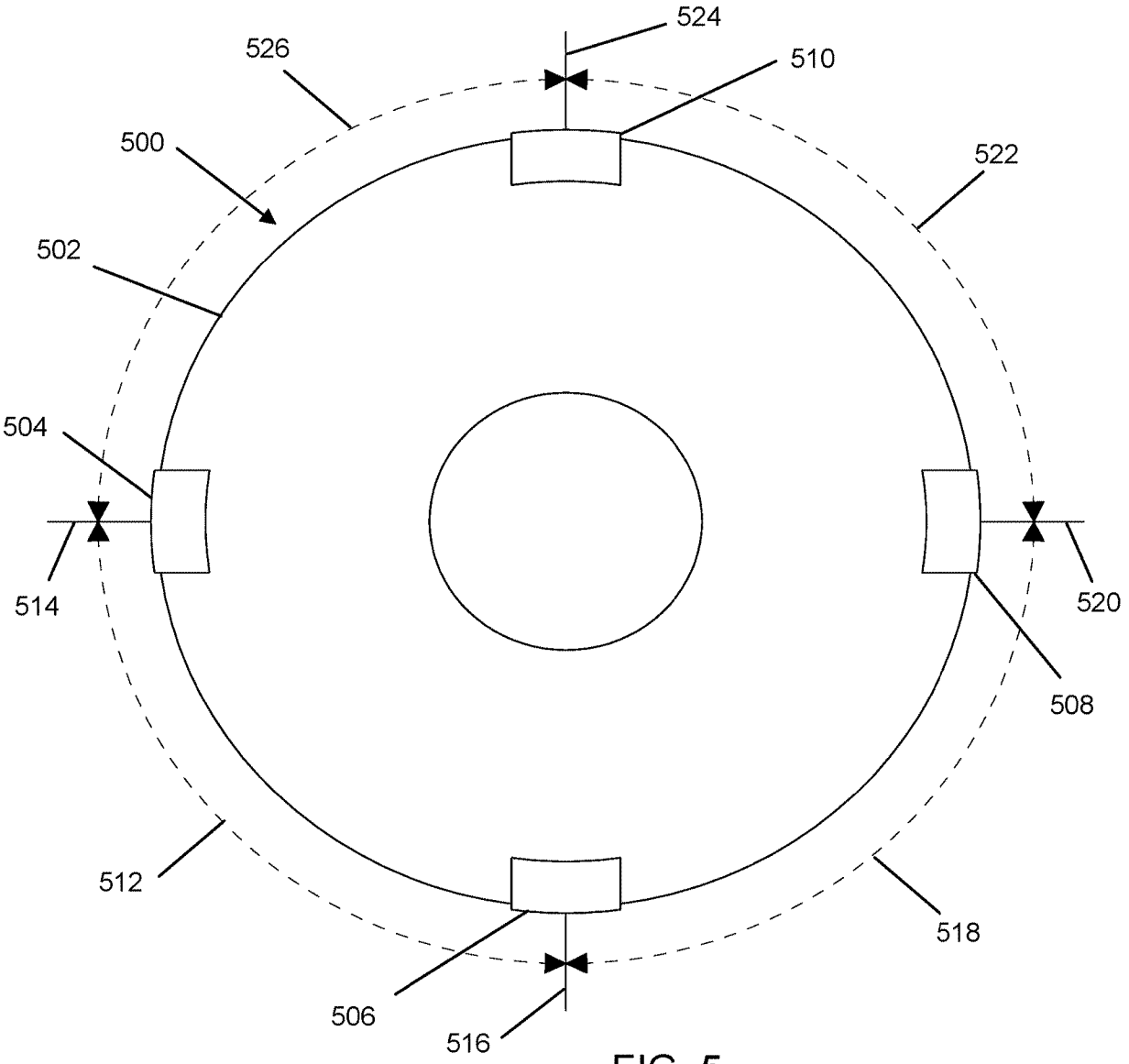
FIG. 5 is a view of the inside of the bell of a musical instrument along the conical axis of the bell and showing a third number of edge protection devices attached to the edge of the bell according to some embodiments.

FIG. 5 is a view of the inside of a bell 500 of a musical instrument along the conical axis of the bell 500 and showing a third number of edge protection devices attached to the edge of the bell 500 according to some embodiments. In the illustrative example of FIG. 5, the bell 500 includes an outer edge 502. The diameter of the bell 500 can be determined by measuring a distance between a first point on the edge to a second point on the edge directly across from the first point. The diameter of the bell 500 can depend on the type of musical instrument that includes the bell 500. For example, a trumpet can have a first set of diameters and a baritone horn can have a second set of diameters that is larger than the first set of diameters. Additionally, a euphonium can have a third set of diameters that is different from the first set of diameters and the second set of diameters, while a tuba can have a fourth set of diameters that is larger than the first, second, and third sets of diameters.

In some embodiments, a diameter of the bell 500 can be at least about 3 inches, at least about 5 inches, at least about 7 inches, at least about 10 inches, at least about 12 inches, at least about 15 inches, or at least about 18 inches. Additionally, a diameter of the bell 500 can be no greater than about 38 inches, no greater than about 35 inches, no greater than about 32 inches, no greater than about 30 inches, no greater than about 28 inches, no greater than about 25 inches, no greater than about 22 inches, or no greater than about 20 inches. In illustrative examples, a diameter of the bell 500 can be from about 3 inches to about 30 inches. In other illustrative examples, a diameter of the bell 500 can be from about 4 inches to about 10 inches. In additional illustrative examples, a diameter of the bell 500 can be from about 6 inches to about 15 inches. In further illustrative examples, a diameter of the bell 500 can be from about 10 inches to about 18 inches. In still other illustrative examples, a diameter of the bell 500 can be from about 15 inches to about 25 inches. In yet additional illustrative examples, a diameter of the bell 500 can be from about 18 inches to about 25 inches. In certain illustrative examples, a diameter of the bell 500 can be from about 20 inches to about 30 inches. In particular illustrative examples, a diameter of the bell 500 can be from about 25 inches to about 35 inches. In various illustrative examples, a diameter of the bell 500 can be from about 30 inches to about 40 inches. In addition, the diameter of the bell 500 can lie within a range that includes various combinations of the diameters listed in this paragraph.

Attached to the bell 500 in the illustrative example of FIG. 5 are a first edge protection device 504, a second edge protection device 506, a third edge protection device 508, and a fourth edge protection device 510. The first edge protection device 504 is separated from the second edge protection device 506 by a first distance 512. The first distance 512 can be measured from a center of the first edge protection device 504 indicated by reference identifier 514 and a center of the second edge protection device 506 indicated by reference identifier 516. Additionally, the second edge protection device 506 can be separated from the third edge protection device 508 by a second distance 518. The second distance 518 can be measured from the center 516 to a center of the third edge protection device 508 indicated by reference identifier 520. Further, the third edge protection device 508 can be separated from the fourth edge protection device 510 by a third distance 522. The third distance 522 can be measured from the center 520 to a center of the fourth edge protection device 510 indicated by reference identifier 524. The fourth edge protection device 510 and the first edge protection device 504 can be separated by a fourth distance 526. The fourth distance 526 can be measured from the center 524 to the center 514. For illustrative purposes, the first distance 512, the second distance 518, the third distance 522, and the fourth distance 526 are shown as being beyond the circumference of the bell 500, but the distances 512, 518, 522, and 526 can be measured along the circumference of the bell 500.

In various embodiments, the first distance 512, the second distance 518, the third distance 522, and the fourth distance 526 can have a value that is approximately a same value. For example, the first distance 512 can include about one-fourth of the circumference of the bell 500, the second distance 518 can include about one-fourth of the circumference of the bell 500, the third distance 522 can include about one-fourth of the circumference of the bell 500, and the fourth distance 526 can include about one-fourth of the circumference of the bell 500. Thus, in certain embodiments, the edge protection devices 504, 506, 508, 510 can be spaced substantially evenly around the circumference of the bell 500. In additional examples, one or more of the first distance 512, the second distance 518, the third distance 522, and the fourth distance 526 can have different values. In some examples, the first distance 512, the second distance 518, the third distance 522, and the fourth distance 526 can have values from about 10% of the value of the circumference of the bell 500 to about 50% of the value of the circumference of the bell 500. In additional examples, the first distance 512, the second distance 518, the third distance 522, and the fourth distance 526 can have values from about 15% of the value of the circumference of the bell 500 to about 30% of the value of the circumference of the bell 500.

In some embodiments, the distances 512, 518, 522, 526 can be from about 1 inch to about 4 inches, from about 2 inches to about 6 inches, from about 3 inches to about 7 inches, from about 4 inches to about 8 inches, from about 5 inches to about 10 inches, from about 6 inches to about 12 inches, from about 7 inches to about 14 inches, from about 10 inches to about 15 inches, from about 12 inches to about 18 inches, from about 15 inches to about 20 inches, from about 18 inches to about 24 inches, from about 20 inches to about 28 inches, or from about 25 inches to about 35 inches. In various embodiments, the first distance 512 and the second distance 518 can be from about 1 inch to about 3 inches, from about 2 inches to about 4 inches, from about 3 inches to about 5 inches, from about 4 inches to about 6 inches, from about 5 inches to about 7 inches, from about 6 inches to about 8 inches, from about 8 inches to about 15 inches, from about 10 inches to about 20 inches, from about 15 inches to about 25 inches, from about 20 inches to about 30 inches, from about 25 inches to about 35 inches, or from about 30 inches to about 40 inches, while the third distance 522 and the fourth distance 526 can be from about 2 inches to about 5 inches, from about 3 inches to about 6 inches, from about 4 inches to about 7 inches, from about 5 inches to about 8 inches, from about 6 inches to about 9 inches, from about 7 inches to about 10 inches, from about 8 inches to about 11 inches, from about 9 inches to about 12 inches, from about 10 inches to about 15 inches, from about 12 inches to about 18 inches, from about 15 inches to about 25 inches, or from about 20 inches to about 30 inches.

Although the illustrative examples of FIG. 3, FIG. 4, and FIG. 5 shows three edge protection devices, two edge protection devices, and four edge protection devices, respectively, coupled to the edges of the respective bells 300, 400, 500, in other embodiments a different number of edge protection devices can be coupled to the edge of the bell of a musical instrument at various locations and at distances described with respect to the edge protection devices of FIG. 3, FIG. 4, and FIG. 5. For example, five or six edge protection devices can be placed on a bell of a musical instrument with various distances between them from about 5 inches to about 15 inches or from about 10 inches to about 20 inches.

Figure 6:
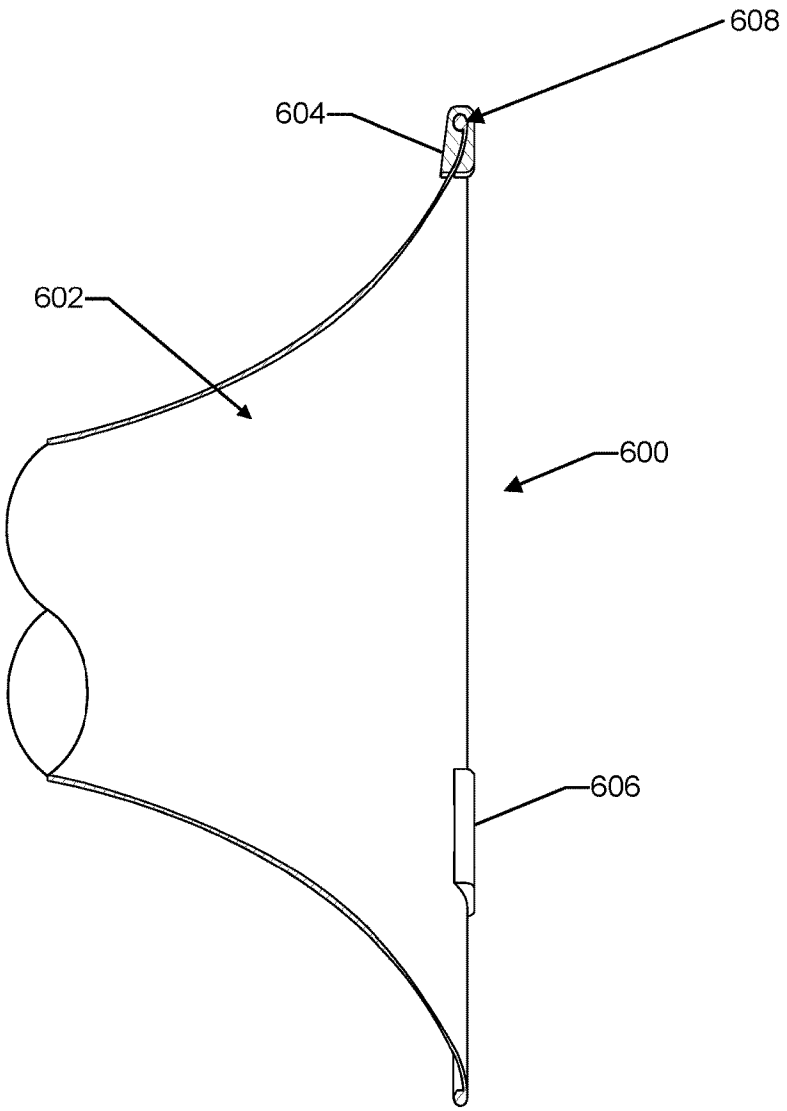
FIG. 6 is a cross section of the bell of a musical instrument taken along line A-A of FIG. 3 and showing a first edge protection device located along a first portion of the bell and a second edge protection device located along a second portion of the bell according to some embodiments.

FIG. 6 is a cross section of a bell 600 of a musical instrument 602 taken along line A-A of FIG. 3 and showing a first edge protection device 604 located along a first portion of the bell 600 and a second edge protection device 606 located along a second portion of the bell 600 according to some embodiments. The first edge protection device 604 and the second edge protection device 606 can be coupled to the bell 600 securely such that the first edge protection device 604 and the second edge protection device 606 remain on the bell 600 with minimal or no movement while the musical instrument 602 is in use.

In the illustrative example of FIG. 6, the first edge protection device 604 is coupled to a beaded region 608 of the bell 600. The shape of the first edge protection device 604 can correspond to a shape of the beaded region 608. In this way, the first edge protection device 604 can be coupled to the bell 600 securely such that the first edge protection device 604 remains on the bell 600 with minimal or no movement while the musical instrument 602 is in use. The first edge protection device 604 can be formed from a material that enables the first edge protection device 604 to be conformed to the shape of the bell 600. In particular embodiments, the interior portion of the edge protection device 604 can contact the surface of the bell 600. In certain embodiments, at least about 10%, at least about 20%, at least about 30%, at least about 40%, at least about 50%, at least about 60%, at least about 70%, at least about 80%, at least about 90%, at least about 95%, or at least about 99% of the surface area of the interior portion of the first edge protection device 604 contacts a surface of the bell 600. In some embodiments, substantially all of the surface area of the interior portion of the first edge protection device 604 contacts a surface of the bell 600.

Figure 7:
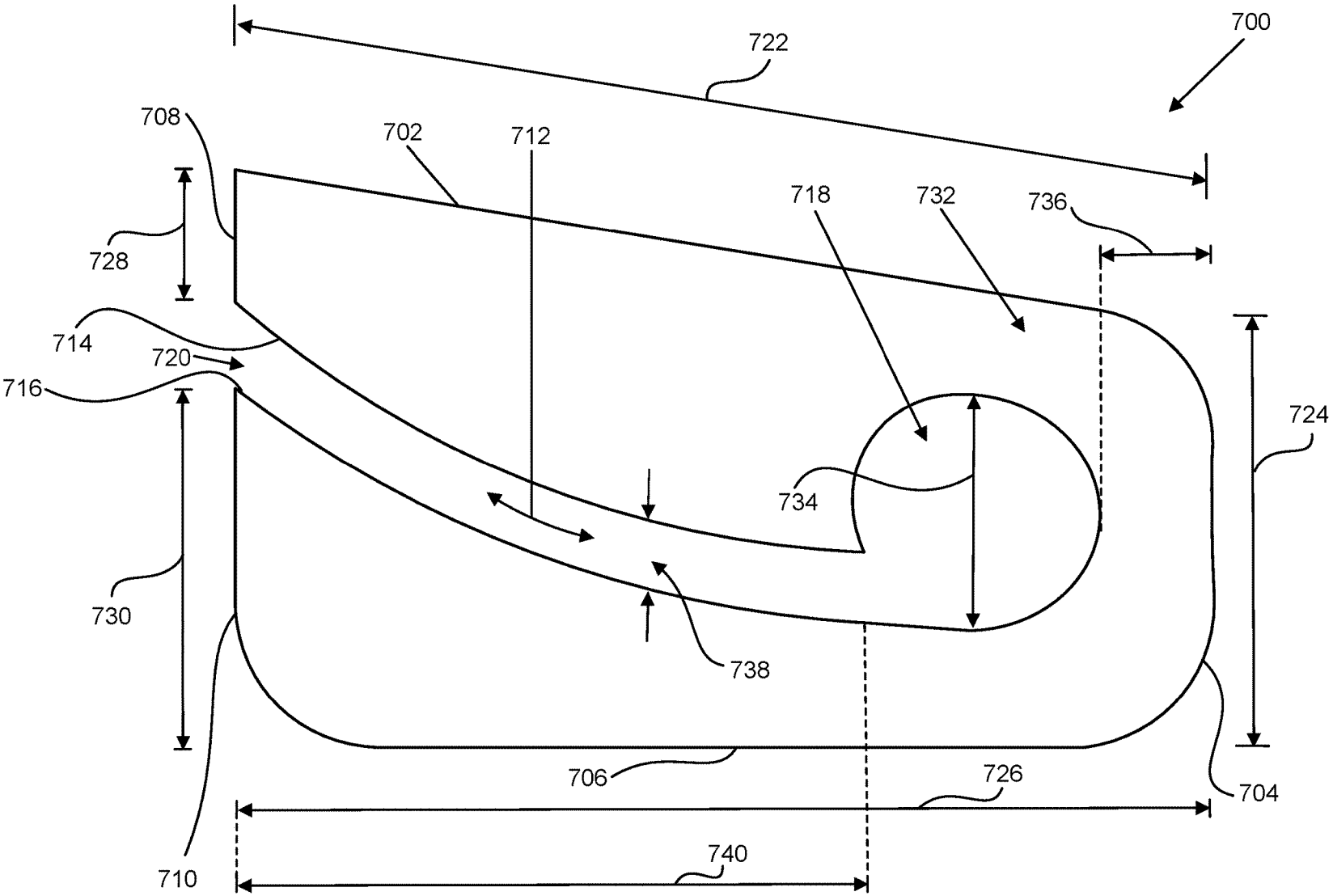
FIG. 7 is a side view of a first implementation of an edge protection device according to some embodiments.

FIG. 7 is a side view of a first implementation of an edge protection device 700 according to some embodiments. The edge protection device 700 can include a first outer surface 702, a second outer surface 704, a third outer surface 706, a fourth outer surface 708, and a fifth outer surface 710. The edge protection device 700 can also include an interior portion that has a channel 712. The channel 712 can include a first inner surface 714 and a second inner surface 716. The interior portion can also include a region 718 formed at an end of the channel 712 such that the channel 712 terminates in terminal region 718. In various embodiments, the terminal region 718 can have a shape that corresponds to a shape of an edge of an object. In illustrative examples, the terminal region 718 can have a circular shape. The channel 712 can be formed by an opening 720 formed in the material that comprises the edge protection device 700.

The interior portion including the channel 712 and the terminal region 718 can be formed to fit around an edge of a surface. In particular embodiments, the interior portion including the channel 712 and the terminal region 718 can be formed to fit around an edge of a surface of a musical instrument. In certain embodiments, at least portions of the channel 712 and the terminal region 718 can be formed to fit around a bell of a musical instrument. In additional embodiments, at least portions of the channel 712 and the terminal region 718 can be formed to fit around an edge of a musical instrument that has a bell with a beaded region. In the illustrative example of FIG. 7, the interior portion of the edge protection device 700 can be formed such that the terminal region 718 contacts a beaded region of a bell of a musical instrument and the first interior surface 714 and the second interior surface 716 can contact additional portions of the bell of the musical instrument.

The first outer surface 702 can have a first dimension 722, the second outer surface 704 can have a second dimension 724, the third outer surface 706 can have a third dimension 726, the fourth outer surface 708 can have a fourth dimension 728, and the fifth outer surface 710 can have a fifth dimension 730. In certain embodiments, the second dimension 724 can be referred to as a first width of the edge protection device 700 and the third dimension 726 can be referred to as a height of the edge protection device 700. Additionally, the fourth dimension 728, the fifth dimension 730, and a width of the opening 720 can, in combination, also be referred to as a second width of the edge protection device 700. In various embodiments, the first width represented by the second dimension 724 can be substantially similar to the second width represented by the combination of the fourth dimension 728, the fifth dimension 730, and a width of the opening 720. In other embodiments, the first width represented by the second dimension 724 can be different from the second width represented by the combination of the fourth dimension 728, the fifth dimension 730, and a width of the opening 720.

In some examples, the first dimension 722 can have values from about 0.4 inches to about 6 inches. In other examples, the first dimension 722 can have values from about 0.5 inches to about 2 inches. Additionally, the second dimension 724 can have values from about 0.05 inches to about 2 inches. In additional examples, the second dimension 724 can have values from about 0.2 inches to about 0.6 inches. The third dimension 726 can have values from about 0.4 inches to about 6 inches. In particular examples, the third dimension 726 can have values from about 0.5 inches to about 2 inches. The fourth dimension 728 can have values from about 0.02 inches to about 2 inches. In certain examples, the fourth dimension 728 can have values from about 0.05 inches to about 0.5 inches. The fifth dimension 730 can have values from about 0.1 inches to about 2 inches. In various examples, the fifth dimension 730 can have values from about 0.2 inches to about 1 inch.

The interior portion including the channel 712 and the terminal region 718 can be free of the material that forms a body 732 of the edge protection device 700. The terminal region 718 of the interior portion 712 can have a sixth dimension 734. The sixth dimension 734 can measure a maximum distance across the terminal region 718. In some embodiments, the sixth dimension 734 can be a width of the terminal region 718. The sixth dimension 734 can have values from about 0.02 inches to about 1.5 inches. In additional examples, the sixth dimension 734 can have values from about 0.1 inches to about 0.5 inches. The edge protection device 700 can also include a seventh dimension 736 that represents a distance between a point of the terminal region 718 and a point on the second outer surface 704 that represents a minimum distance between the terminal region 718 and the second outer surface 704. The seventh dimension 736 can have values from about 0.01 inches to about 5.5 inches. In particular examples, the seventh dimension 736 can have values from about 0.02 inches to about 0.4 inches. In various situations, the seventh dimension 736 can be referred to herein as a transition distance.

The channel 712 can have an eighth dimension 738 and a ninth dimension 740. In some embodiments, the eighth dimension 738 can be a width of the channel 712 and the ninth dimension 740 can be a length of the channel 712. The eighth dimension 738 can have values when the edge protection device 700 is not coupled to an object that are no greater than about 0.01 inches, no greater than about 0.02 inches, no greater than about 0.05 inches, no greater than about 0.1 inches, no greater than about 0.2 inches, or no greater than about 0.5 inches. In particular embodiments, when the edge protection device 700 is not coupled to an object, at least a portion of the first inner surface 714 contacts at least a portion of the second inner surface 716. Additionally, the ninth dimension 740 can have values from about 0.2 inches to about 1 inch. In illustrative examples, the ninth dimension 740 can have values from about 0.3 inches to about 5.5 inches. When the edge protection device 700 is coupled to a musical instrument, the dimensions of the interior portion, such as the dimensions of the channel 712 and the terminal region 718 can expand based on the size of the edge of the musical instrument.

Figure 8:
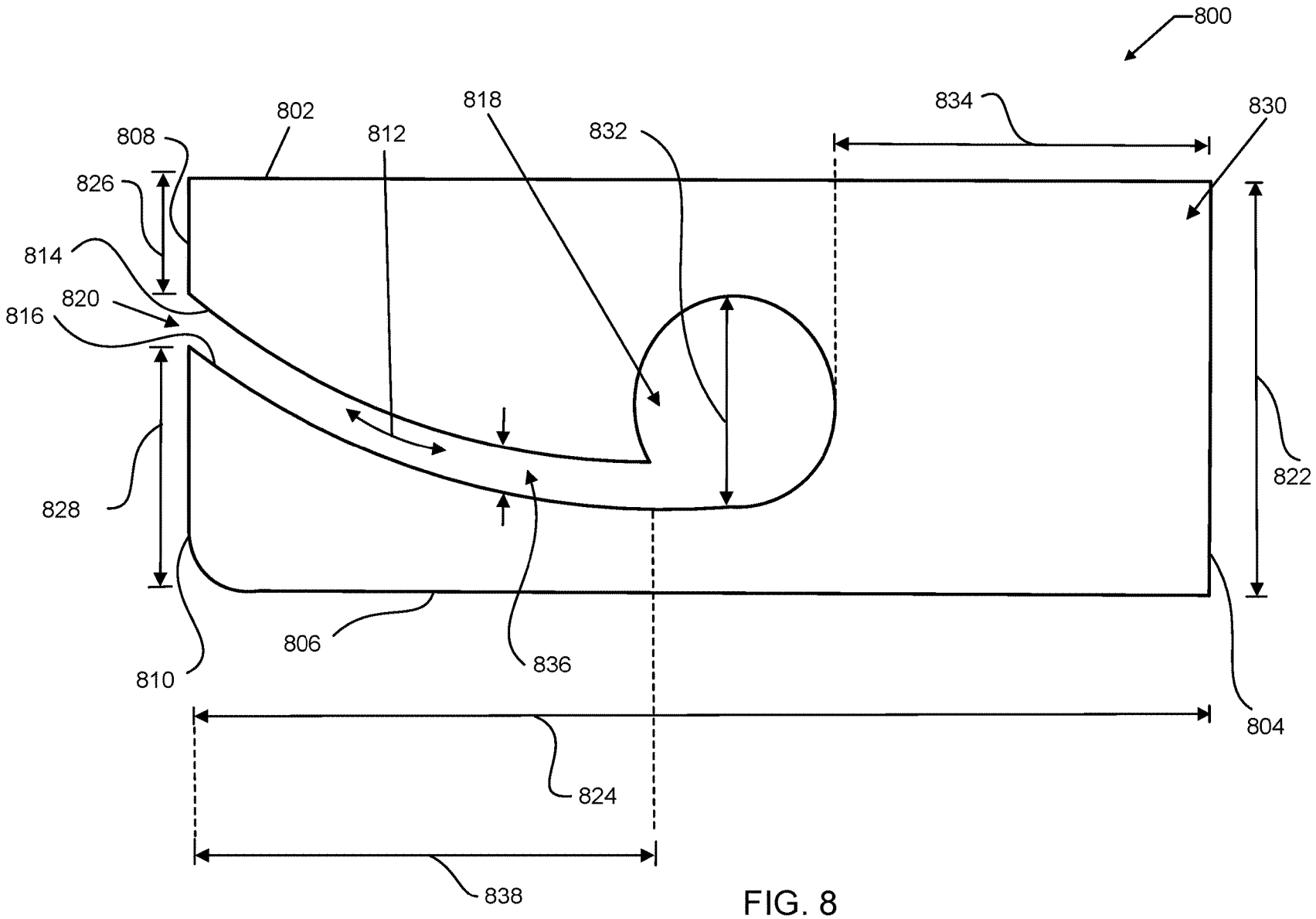
FIG. 8 is a side view of a second implementation of an edge protection device according to some embodiments.

FIG. 8 is a side view of a second implementation of an edge protection device 800 according to some embodiments. The edge protection device 800 can include a first outer surface 802, a second outer surface 804, a third outer surface 806, a fourth outer surface 808, and a fifth outer surface 810. The edge protection device 800 can also include an interior portion that includes a channel 812. The channel 812 can include a first inner surface 814 and a second inner surface 816. The interior portion can also include a region 818 formed at an end of the channel 812 such that the channel 812 terminates in region 818. In some implementations, the terminal region 818 can have a shape that corresponds to an edge of an object. In illustrative examples, the terminal region 818 can have a circular shape. The channel 812 can be formed by an opening 820 formed in the material that comprises the edge protection device 800.

The interior portion including the channel 812 and the terminal region 818 can be formed to fit around an edge of a surface. In particular embodiments, the interior portion including the channel 812 and the terminal region 818 can be formed to fit around an edge of a surface of a musical instrument. In certain embodiments, at least portions of the channel 812 and the terminal region 818 can be formed to fit around a bell of a musical instrument. In additional embodiments, at least portions of the channel 812 and the terminal region 818 can be formed to fit around an edge of a musical instrument that has a bell with a beaded region. In the illustrative example of FIG. 8, the interior portion of the edge protection device 800 can be formed such that the terminal region 818 contacts a beaded region of a bell of a musical instrument and the first interior surface 814 and the second interior surface 816 can contact additional portions of the bell of the musical instrument.

The second outer surface 804 can have a first dimension 822, the third outer surface 806 can have a second dimension 824, the fourth outer surface 808 can have a third dimension 826, and the fifth outer surface 810 can have a fourth dimension 828. In certain embodiments, the first dimension 822 can be referred to as a first width of the edge protection device 800 and the second dimension 824 can be referred to as a height of the edge protection device 800. Additionally, the third dimension 826, the fourth dimension 828, and a width of the opening 820 can, in combination, also be referred to as a second width of the edge protection device 800. In various embodiments, the first width represented by the first dimension 822 can be substantially similar to the second width represented by the combination of the third dimension 826, the fourth dimension 828, and a width of the opening 820. In other embodiments, the first width represented by the first dimension 822 can be different from the second width represented by the combination of the third dimension 826, the fourth dimension 828, and a width of the opening 820.

In some examples, the first dimension 822 can have values from about 0.05 inches to about 2 inches. In other examples, the first dimension 822 can have values from about 0.2 inches to about 0.6 inches. Additionally, the second dimension 824 can have values from about 0.4 inches to about 6 inches. In additional examples, the second dimension 824 can have values from about 0.5 inches to about 2 inches. The third dimension 826 can have values from about 0.02 inches to about 2 inches. In particular examples, the third dimension 826 can have values from about 0.05 inches to about 0.5 inch. The fourth dimension 828 can have values from about 0.1 inches to about 2 inches. In certain examples, the fourth dimension 828 can have values from about 0.2 inches to about 1 inch.

The interior portion 812 can be free of the material that forms a body 830 of the edge protection device 800. The terminal region 818 of the interior portion 812 can have a fifth dimension 832. The fifth dimension 832 can measure a maximum distance across the terminal region 818. The fifth dimension 832 can have values from about 0.02 inches to about 1.5 inches. In additional examples, the fifth dimension 832 can have values from about 0.1 inches to about 0.5 inches. The edge protection device 800 can also include a sixth dimension 834 that represents a distance between a point of the terminal region 818 and a point of the second outer surface 804 that represents a minimum distance between the terminal region 818 and the second outer surface 804. The sixth dimension 834 can have values from about 0.1 inches to about 5.5 inches. In particular examples, the sixth dimension 834 can have values from about 0.2 inches to about 0.5 inches. In various situations, the sixth dimension 834 can be referred to herein as a transition distance.

The channel 812 can have a seventh dimension 836 and an eighth dimension 838. In some embodiments, the seventh dimension 836 can be a width of the channel 812 and the eighth dimension 838 can be a length of the channel 812. The seventh dimension 836 can have values when the edge protection device 800 is not coupled to an object that are no greater than about 0.01 inches, no greater than about 0.02 inches, no greater than about 0.05 inches, no greater than about 0.1 inches, no greater than about 0.2 inches, or no greater than about 0.5 inches. In particular embodiments, when the edge protection device 800 is not coupled to an object, at least a portion of the first inner surface 814 contacts at least a portion of the second inner surface 816. Additionally, the eighth dimension 838 can have values from about 0.2 inches to about 5.5 inches. In illustrative examples, the eighth dimension 838 can have values from about 0.3 inches to about 2 inches. When the edge protection device 800 is coupled to a musical instrument, the dimensions of the interior portion, such as the dimensions of the channel 812 and the terminal region 818 can expand based on the size of the edge of the musical instrument.

Figure 9:
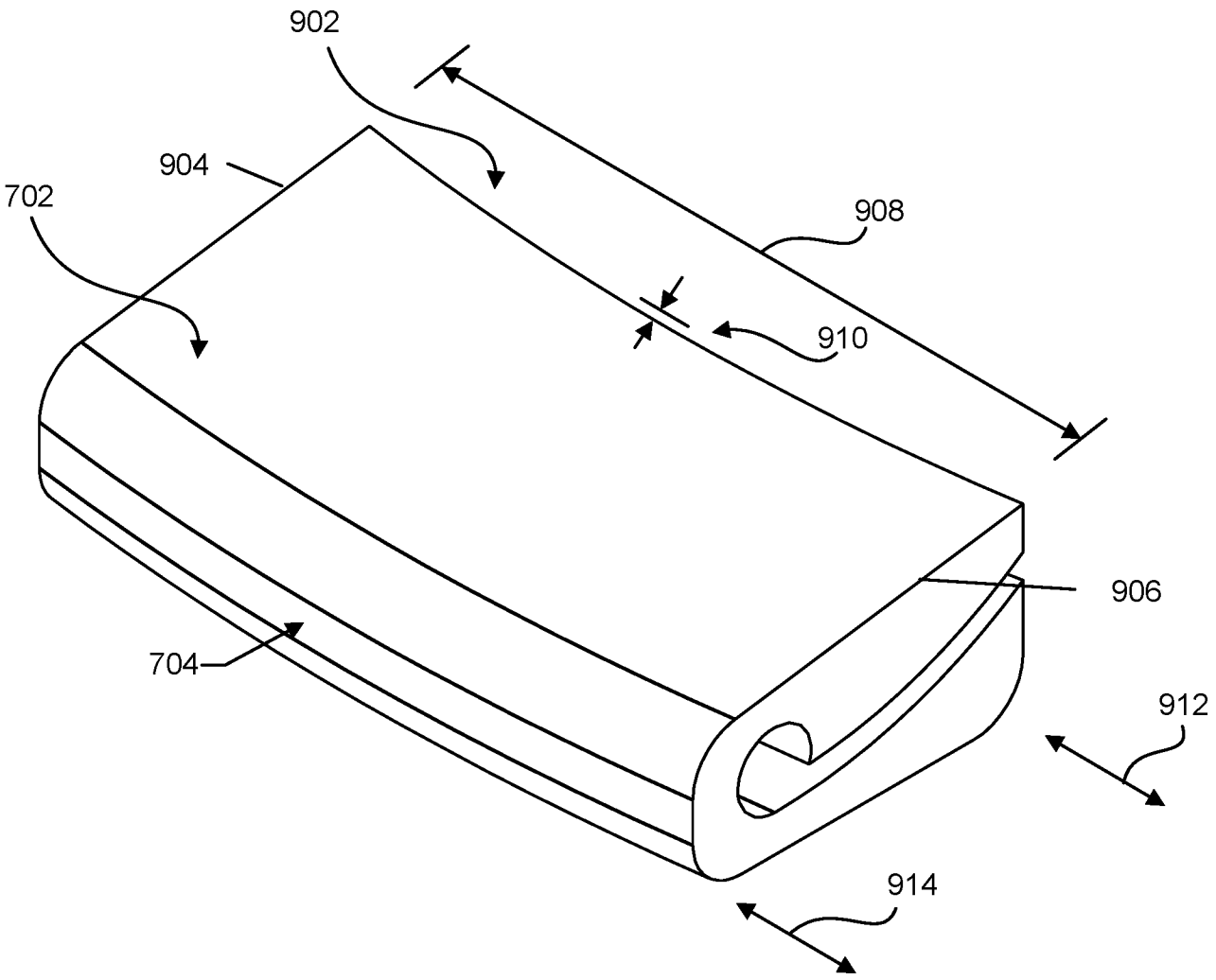
FIG. 9 is a perspective view of the first implementation of the edge protection device according to some embodiments.

FIG. 9 is a perspective view of the first implementation of the edge protection device 700 according to some embodiments. The edge protection device 700 includes an arced region 902 between a first edge 904 of the edge protection device 700 and a second edge 906 of the edge protection device 700. The illustrative example of FIG. 9 shows a first additional dimension 908 of the edge protection device 700 and the first outer surface 702. The arced region 902 can include an arc height 910. In certain examples, the arc height 910 can be from about 0.01 inches to about 2 inches. In other examples, the arc height 910 can be from 0.05 inches to about 0.5 inches. In certain implementations, the arc height 910 can be larger. For example, the arc height 910 can be from about 2 inches to about 40 inches, from about 5 inches to about 30 inches, from about 10 inches to about 20 inches, or from about 12 inches to about 18 inches.

A center point of the arced region 902 can be disposed along a first axis 912 that runs at least substantially perpendicular to the first edge 904 and the second edge 906. In particular implementations, the first axis 912 can be disposed at least substantially parallel to a second axis 914 that corresponds to a rounded side of the edge protection device 700. The rounded side of the edge protection device 700 can correspond to the second outer surface 704. Additionally, although the illustrative example of FIG. 9 shows that the edge protection device 700 can have a rounded side, in other implementations, the surface 704 can be substantially flat. Furthermore, although the edge protection device 700 has a particular design in the illustrative example of FIG. 9, in additional embodiments, the edge protection device 700 can have various ornamental designs.

In various embodiments, the first additional dimension 908 can have a value from about 1 inch to about 6 inches. In other examples, the first additional dimension 908 can have a value from about 0.8 inches to about 3.5 inches. In certain examples, the first additional dimension 908 can have a value from about 1 inch to about 2 inches. In additional examples, the first additional dimension 908 can have a value from about 2.5 inches to about 3.5 inches. In still other implementations, the first additional dimension 908 can be from about 5 inches to about 115 inches, from about 10 inches to about 100 inches, from about 20 inches to about 80 inches, from about 30 inches to about 70 inches, or from about 40 inches to about 60 inches.

The edge protection device 700 can comprise one or more of the edge protection devices 204, 206, 208 of FIG. 2; one or more of the edge protection devices 304, 306, 308 of FIG. 3; one or more of the edge protection devices 404, 406 of FIG. 4; or one or more of the edge protection devices 504, 506, 508, 510 of FIG. 5. In some implementations, different sizes of the edge protection device 700 can comprise one or more of the edge protection devices 204, 206, 208 of FIG. 2; one or more of the edge protection devices 304, 306, 308 of FIG. 3; one or more of the edge protection devices 404, 406 of FIG. 4; or one or more of the edge protection devices 504, 506, 508, 510 of FIG. 5. In an illustrative example, two edge protection devices 700 having a first value of the first additional dimension 908 can be utilized in conjunction with a single edge protection device 700 having a second value of the first additional dimension 908 that is greater than the first value. With reference to the illustrative examples of FIG. 3 and FIG. 7, a first edge protection device 700 can be placed at the position of the second edge protection device 306 of FIG. 3 and a second edge protection device 700 can be placed at the position of the third edge protection device 308 of FIG. 3 and can have a first value of the first additional dimension 908. Additionally, a third edge protection device 700 can be placed at the position of the first edge protection device 304 of FIG. 3 and can have a second value of the first additional dimension 908 that is greater than the first value. In these situations, the first value of the first additional dimension 908 can be from about 1.1 inches to about 2.2 inches and the second value of the first additional dimension 908 can be from about 2.6 inches to about 3.4 inches.

Figure 10:
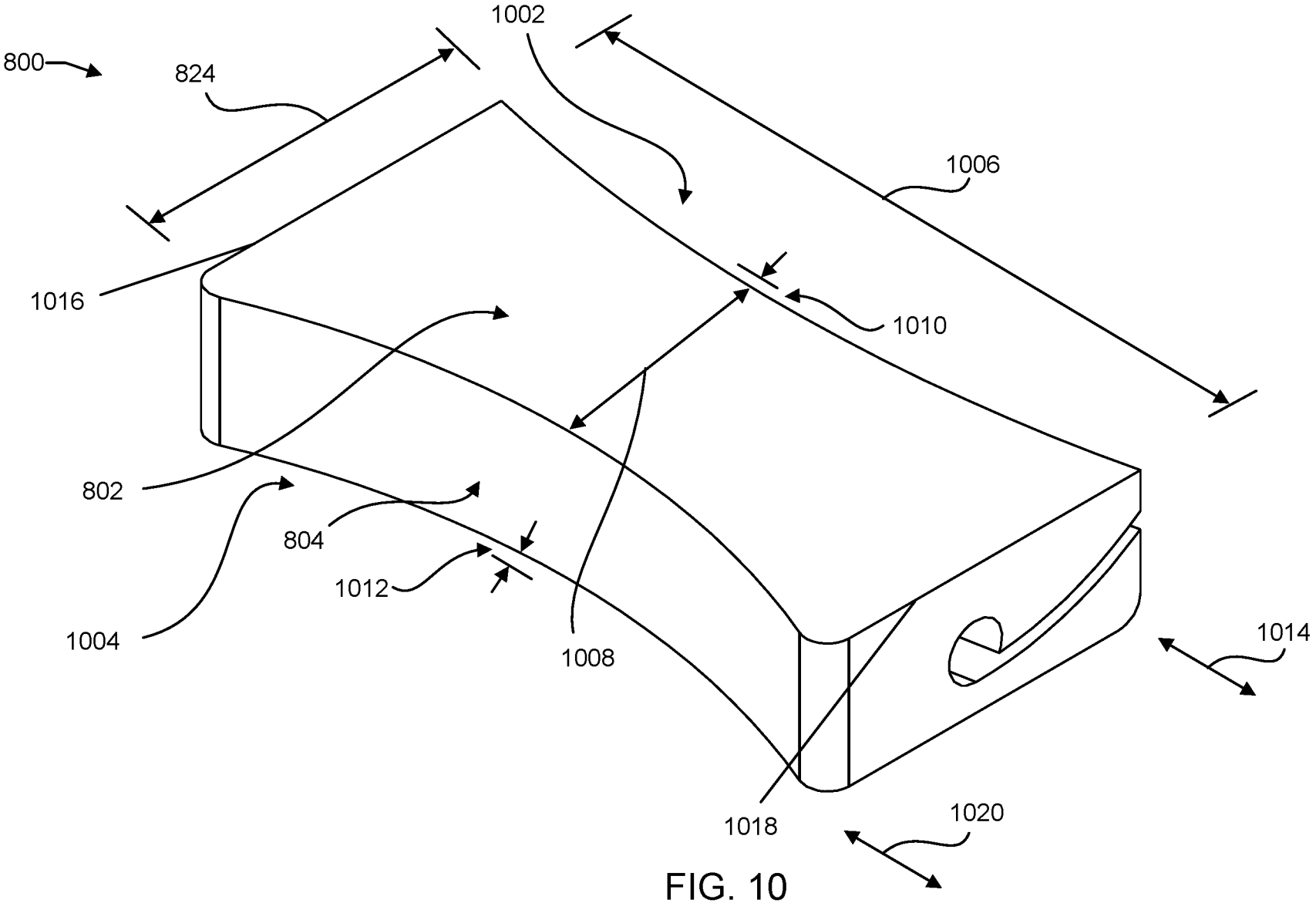
FIG. 10 is a perspective view of a second implementation of the edge protection device according to some implementations.

FIG. 10 is a perspective view of a second implementation of the edge protection device 800 according to some implementations. The edge protection device 800 includes a first arced region 1002 and a second arced region 1004. The illustrative example of FIG. 10 shows the second dimension 824 of the edge protection device 800. The edge protection device 800 also has a first additional dimension 1006 and a second additional dimension 1008. The first additional dimension 1006 can include a value from about 1 inch to about 6 inches. In additional examples, the first additional dimension 1006 can have a value from about 2 inches to about 3 inches. The second additional dimension 1008 can be less than the second dimension 824 due to the arced regions 1002, 1004. The second additional dimension 1008 can have values from about 0.3 inches to about 5 inches. In other examples, the second additional dimension 1008 can have values from about 0.4 inches to about 1.5 inches. In still other implementations, the first additional dimension 1006 can be from about 5 inches to about 115 inches, from about 10 inches to about 100 inches, from about 20 inches to about 80 inches, from about 30 inches to about 70 inches, or from about 40 inches to about 60 inches.

The arced regions 1002, 1004 can have an arc height, such as the representative arc height 1010 shown in FIG. 10. The arc height 1010 can be from about 0.01 inches to about 2 inches. In certain examples, the arc height 1010 can be from about 0.05 inches to about 0.5 inches. In certain implementations, the arc height 1010 for one of the arced regions 1002 or 1004 can be larger. For example, the arc height 1010 for the first arced region 1002 can be from about 2 inches to about 40 inches, from about 5 inches to about 30 inches, from about 10 inches to about 20 inches, or from about 12 inches to about 18 inches and an additional arc height 1012 of the second arced region 1004 can be less than the arc height 1010, such as from about 0.01 inches to about 20 inches.

A center point of the arced region 1002 can be disposed along a first axis 1014 that runs at least substantially perpendicular to a first edge 1016 and a second edge 1018 of the edge protection device 800. Additionally, a center point of the second arced region 1004 can be disposed along a second axis 1020 that also runs at least substantially perpendicular to the first edge 1016 and the second edge 1018. The first axis 1014 can be disposed at least substantially parallel to a second axis 1020.

In some cases, the edge protection device 800 can be utilized in conjunction with one or more edge protection devices 700. In certain implementations, the edge protection device 800 can replace one or more of the edge protection devices 204, 206, 208 of FIG. 2; one or more of the edge protection devices 304, 306, 308 of FIG. 3; one or more of the edge protection devices 404, 406 of FIG. 4; or one or more of the edge protection devices 504, 506, 508, 510 of FIG. 5. In a particular illustrative example, the edge protection device 800 can replace the first edge protection device 304 of FIG. 3.

The subject matter described above is provided by way of illustration only and should not be construed as limiting. Furthermore, the claimed subject matter is not limited to implementations that solve any or all disadvantages noted in any part of this disclosure. Various modifications and changes can be made to the subject matter described herein without following the example configurations and applications illustrated and described, and without departing from the true spirit and scope of the embodiments of the present invention, which is set forth in the following claims.

What is claimed is:

1. A device to protect an edge of an object, the device comprising:

an interior portion that is configured to couple to the edge of the object, the interior portion including a curved channel that terminates in a circular terminal region, the curved channel having a first width that is less than a second width of the circular terminal region.

2. The device of claim 1, wherein the device is formed from a thermoplastic polyurethane-containing material having an ultimate tensile strength from about 18 megapascals (Mpa) to about 35 Mpa, an elongation at break from about 500% to about 750%, a Shore A hardness from about 75 to 92, and a melting point from about 175° C. to about 250° C.

3. The device of claim 1, further comprising an arced region along a single side of the device, the arced region having an arc height from about 0.01 inches to about 2 inches.

4. The device of claim 1, wherein the channel has a length from about 0.2 inches to about 1 inch and the channel has a width no greater than about 0.1 inches when not attached to the object.

5. The device of claim 1, wherein:

the object is a musical instrument; and the device is configured to be coupled to the musical instrument while the musical instrument is being played.

6. A system to protect an edge of a musical instrument, the system comprising:

an edge protection device including an interior portion that is configured to couple to the edge of the musical instrument, wherein:

the interior portion is formed by an opening in a surface of the edge protection device;

the interior portion includes a channel that terminates in a terminal region;

a length of the edge protection device is from about 0.8 inches to about 6 inches and a height of the edge protection device is from about 0.4 inches to about 6 inches; and a first portion of a width of the edge protection device from the channel to an edge of a first surface of the edge protection device is from about 0.05 inches to about 0.5 inches and a second portion of the width from the channel to an edge of a second surface of the edge protection device is from about 0.2 inches to about 1 inch.

7. The system of claim 6, wherein the terminal region has a circular shape, is configured to engage a bell of the musical instrument, and has a width from about 0.01 inches to about 1.5 inches.

8. The system of claim 6, wherein the edge protection device is formed from a thermoplastic material.

9. The system of claim 6, further comprising a second edge protection device, including a second interior portion that is configured to couple to the edge of the musical instrument, wherein:

the length of the edge protection device is from about 1 inch to about 3 inches, the width of the edge protection device is from about 0.2 inches to about 1 inch, and a height of the edge protection device is from about 0.5 inches to about 1 inch; and a second length of the second edge protection device is from about 1 inch to about 3 inches, a second width of the second edge protection device is from about 0.2 inches to about 1 inch, and a second height of the second edge protection device is from about 0.5 inches to about 1 inch.

10. The system of claim 6, further comprising a second edge protection device, including a second interior portion that is configured to couple to the edge of the musical instrument, wherein:

the length of the edge protection device is from about 1 inch to about 3 inches, the width of the edge protection device is from about 0.2 inches to about 1 inch, and a height of the edge protection device is from about 0.5 inches to about 1 inch; and a second length of the second edge protection device is from about 2.5 inches to about 5 inches, a second width of the second edge protection device is from about 0.2 inches to about 1 inch, and a second height of the second edge protection device is from about 0.5 inches to about 1 inch.

11. The system of claim 6, wherein the edge protection device includes a single arced region disposed along a side of the edge protection device.

12. The system of claim 6, further comprising a second edge protection device, wherein the second edge protection device includes a first arced region disposed along a first side of the second edge protection device and a second arced region disposed along a second side of the second edge protection device, the first side of the second edge protection device being disposed along a first axis that is parallel to a second axis on which the second side of the second edge protection device is disposed.

13. The system of claim 6, wherein a transition distance representing a minimum distance between a first point of an edge of the terminal region and a second point across from the first point on a surface of the edge protection device is from about 0.01 inches to about 0.2 inches.

14. The system of claim 6, further comprising a second edge protection device and a third edge protection device, wherein the edge protection device is placed at a first location on the edge of the musical instrument, the second edge protection device is placed at a second location on the edge of the musical instrument, and the third edge protection device is placed at a third location on the edge of the musical instrument.

15. The system of claim 14, wherein:

the edge protection device and the second edge protection device are separated by a first distance along the edge of the musical instrument;

the second edge protection device and the third edge protection device are separated by a second distance along the edge of the musical instrument; and the third edge protection device and the edge protection device are separated by a third distance along the edge of the musical instrument.

16. The system of claim 6, wherein the musical instrument includes a tuba, a euphonium, a baritone, a mellophone, a trumpet, a horn, or a drum and a width of the terminal region is greater than a width of the channel when the edge protection device is not coupled to the musical instrument.

17. A device to protect an edge of a musical instrument, the device comprising:

an interior portion that is configured to couple to the edge of the musical instrument, the interior portion including a channel extending through a body of the device that terminates in a terminal region, wherein the device includes a first concave arced region along a first side of the device and a second concave arced region along a second side of the device, the first side of the edge protection device being disposed along an axis that is parallel to an additional axis on which the second side of the edge protection device is disposed.

18. The device of claim 17, wherein the first concave arced region has a first arc height from about 0.01 inches to about 2 inches and the second concave arced region has a second arc height from about 0.01 inches to about 2 inches.

19. The device of claim 17, wherein a length of the channel is from about 0.2 inches to about 1 inch and a width of the terminal region is from about 0.02 inches to about 0.5 inches.

20. The device of claim 17, wherein a transition distance representing a minimum distance between a first point of an edge of the terminal region and a second point across from the first point on a surface of the device is from about 0.02 inches to about 2 inches.

* * * * *